US007575136B2

(12) United States Patent
Kernkamp

(10) Patent No.: US 7,575,136 B2
(45) Date of Patent: Aug. 18, 2009

(54) CHILD CARRIER BELT

(76) Inventor: Anne Kernkamp, 39055 Liefer Rd., Temecula, CA (US) 92591

( * ) Notice: Subject to any disclaimer, the term of this patent is extended or adjusted under 35 U.S.C. 154(b) by 382 days.

(21) Appl. No.: 11/407,285

(22) Filed: Apr. 20, 2006

(65) Prior Publication Data

US 2007/0246493 A1 Oct. 25, 2007

(51) Int. Cl.
*A61G 5/00* (2006.01)
*A61G 1/00* (2006.01)

(52) U.S. Cl. ..... 224/159; 224/158; 224/161

(58) Field of Classification Search ..... 224/159, 224/158, 161, 270, 664, 907; 2/338, 308, 2/311, 321, 322
See application file for complete search history.

(56) References Cited

U.S. PATENT DOCUMENTS

| | | | | |
|---|---|---|---|---|
| 3,458,188 | A * | 7/1969 | Infante | 472/133 |
| 4,901,898 | A | 2/1990 | Colombo et al. | |
| 5,070,866 | A * | 12/1991 | Alexander et al. | 602/19 |
| 5,086,759 | A | 2/1992 | Buddingh | |
| 5,147,261 | A | 9/1992 | Smith et al. | |
| 5,224,637 | A | 7/1993 | Colombo | |
| 5,388,274 | A | 2/1995 | Glover et al. | |
| 5,421,809 | A | 6/1995 | Rise | |
| 5,464,136 | A * | 11/1995 | Eddy | 224/666 |
| 5,548,843 | A | 8/1996 | Chase et al. | |
| D375,184 | S | 11/1996 | Hickli et al. | |
| 5,586,969 | A | 12/1996 | Yewer, Jr. | |
| D393,363 | S | 4/1998 | Kataoka | |
| 5,833,638 | A | 11/1998 | Nelson | |
| 6,186,381 | B1 * | 2/2001 | Kernkamp | 224/161 |
| D451,605 | S | 12/2001 | Snider | |
| 6,766,532 | B1 | 7/2004 | Cabana | |
| 6,837,406 | B2 * | 1/2005 | Sclafani | 224/159 |
| 2004/0118883 | A1 | 6/2004 | Fife et al. | |

FOREIGN PATENT DOCUMENTS

| | | |
|---|---|---|
| EP | 480573 | 4/1992 |

* cited by examiner

*Primary Examiner*—Nathan J Newhouse
*Assistant Examiner*—Lester L Vanterpool
(74) *Attorney, Agent, or Firm*—Richard C. Litman

(57) ABSTRACT

The child carrier belt has an outer belt of inelastic material with a child support shelf extending laterally therefrom, and an elastic inner belt. The outer belt is formed of two plies of material, with a padded layer sandwiched therebetween. The outer ply of the outer belt is preferably shaped to form an extension when its portions to either side of the extension are attached congruent to the corresponding portions of the inner ply, thus forming a pocket between the two plies of the outer belt and integral with the two plies. A removable insert is placed within the pocket to provide support for a child or infant seat placed thereon. Alternatively, the pocket may be formed of a separate sheet of material from the outer ply of the outer belt. The inner belt has a single ply of elastic material either permanently or removably attached to the outer belt.

16 Claims, 5 Drawing Sheets

CHILD CARRIER BELT

BACKGROUND OF THE INVENTION

1. Field of the Invention

The present invention relates generally to belts and belt assemblies having means for carrying one or more articles thereon. More specifically, the present invention is a multiple component belt having a support shelf extending outwardly therefrom, for carrying and supporting an infant thereon. The device may also be used for the carriage of various accessories, e.g. a portable infant car seat.

2. Description of the Related Art

Infants and very small children are often carried by partially supporting them on the hip of an adult parent or guardian. The mothers of infants and small children particularly use this method of carrying and supporting a small child. This method has various advantages, in that the child is continually held by at least one arm of the adult, the child is positioned where he or she may be easily observed by the adult, and the adult may generally make use of one arm and hand to tend to the needs of the child or to other matters as required.

However, this method of carrying a small child has its disadvantages as well. In order to carry a small child reasonably securely using this method, the hip must be thrust laterally outwardly in order to provide sufficient horizontal support for the child, with one arm restraining the child close to the body of the adult. Even though the child is extremely close to the adult's torso, the adult must still lean at least slightly away from the child in order to balance the laterally offset load. This results in excessive muscular strain and skeletal displacement for the adult carrying the small child, even though the child's weight may not be very great.

As a result, various devices have been developed in the past for carrying and supporting a small child on the body of an adult. These devices generally comprise a single belt with some form of support structure extending therefrom, with the belt generally passing through a passage in the support in order to secure the support adjustably and removably on the belt. Other devices have been developed in which the externally extending support structure is permanently and immovably affixed to the belt. However, nearly all of the child support belt configurations of the related art of which the present inventor is aware have only a single, generally relatively narrow belt to support the weight. Some have recognized this deficiency and have added shoulder straps for additional support and security, but the single, generally narrow belt is nearly universal among such devices.

The need for additional waist support has long been recognized in the field of heavy lifting. Numerous weight belts, back support belts, and the like have been developed in the past. Some of these belts include inelastic outer belt portions formed of plural plies of material, with elastic inner belt sections attached inside the outer belt. However, none of these devices provide any external extension for supporting a load laterally from the body.

Thus, a child carrier belt solving the above noted problems is desired.

SUMMARY OF THE INVENTION

The child carrier belt facilitates the carriage of an infant or small child by an adult parent or guardian by obviating the need for the adult to extend his or her hip laterally to support the child thereon. The child support shelf portion of the belt is capable of supporting a portable infant or child safety seat thereon, with the infant or child in turn being cradled in the seat. Such seats are commonly used in motor vehicles for the safe transport and carriage of infants and small children, and many include means for the removal of the seat from an underlying seat attachment structure, which is installed in the vehicle. The child carrier belt precludes the need for the adult parent or guardian to carry the child and bulky seat directly upon the hip, and is particularly helpful when the adult is traversing uneven terrain or climbing or descending steps or a slope.

The child carrier belt includes an elastic inner belt, which is secured closely about the waist or just above the hips of the user of the device. A non-elastic outer belt attaches (either removably or permanently) to the inner belt and about the wearer, and provides the required strength for a child support structure extending therefrom. The elastic inner belt is secured reasonably firmly about the waist of the wearer, and provides some abdominal and torso support for the wearer. This can be quite beneficial to a woman who has recently given birth, as the elastic belt portion of the child carrier belt assists in restoring abdominal muscles, internal organs, and structures that were distended during the pregnancy and birth. The elastic inner belt also assists in holding the inelastic outer belt in place without the need to secure the inelastic belt tightly. Yet, the elasticity of the inner belt allows the wearer to bend and flex as required during normal activity, with the inelastic outer belt being secured somewhat more loosely to allow such movement without confining the wearer or limiting his or her movement.

The outer belt is preferably formed of two plies of inelastic material with a padded layer captured therebetween. The outer wall of the child support shelf or structure is preferably formed as a unitary, integral part of the outer ply of material of the outer belt, although it could be assembled thereto of a separate sheet of material. The outer belt ply is configured to define a pocket between the outer and inner plies of the outer belt when the two plies are assembled, with a rigid support core or insert being placed within the pocket to provide the required rigidity for the child support shelf. However, the upper surface or cover for the support shelf may be opened and the core removed to allow the pocket of the support shelf to be used for the storage and containment of various accessories.

The outer belt assembly and the inner belt each have their own separate attachments or connection means for securing them independently about the wearer. A third supplemental belt end connection means may be provided for the outer belt for additional security, if so desired. The outer belt may include additional attachments, if so desired, for holding other articles, such as a baby bottle, keys, and other loose articles.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
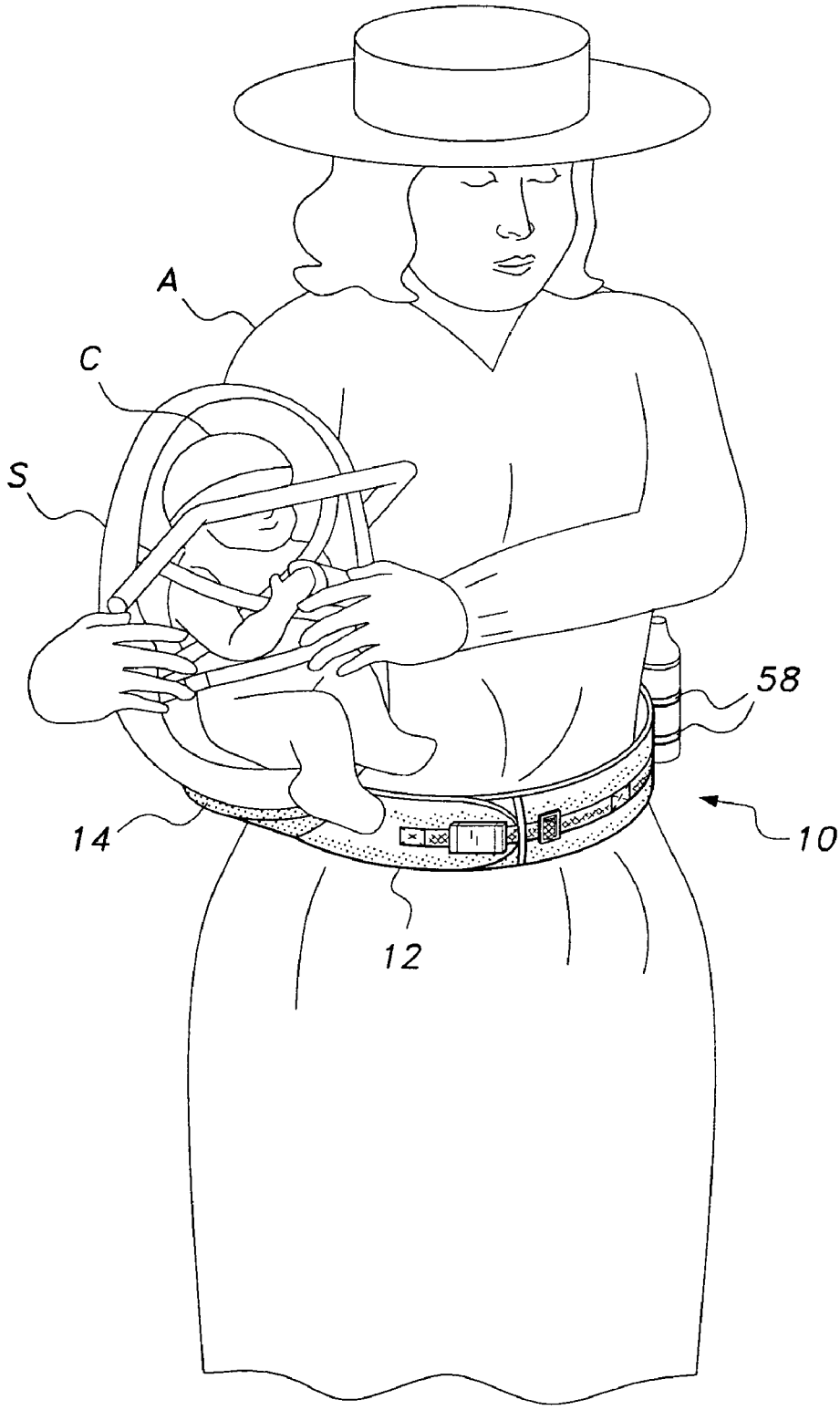
FIG. 1 is an environmental, perspective view of a child carrier belt according to the present invention being worn about the waist of a parent or guardian, showing its use in supporting a child in a child safety seat.

The present invention comprises a child carrier belt, with the belt being secured about the waist of a parent or guardian and providing support for an infant or small child or portable infant car seat placed thereon and held by the wearer of the belt. FIG. 1 provides an environmental view of the child carrier belt 10, showing the belt 10 as it would be worn or secured about the waist of an adult parent or guardian A. The belt 10 generally comprises an inelastic outer belt assembly 12 having a child support shelf 14 extending outwardly therefrom. The child support shelf 14 allows an infant or small child C or portable infant car seat S to be carried by the adult A without excessive lateral displacement of the hip of the adult when carrying a child C in such a position. In the exemplary view of FIG. 1, the child C is being carried in a portable car seat S, with the seat S in turn resting upon the support shelf 14. The child C may be carried or supported directly atop the support shelf 14, if desired.

Figure 2:
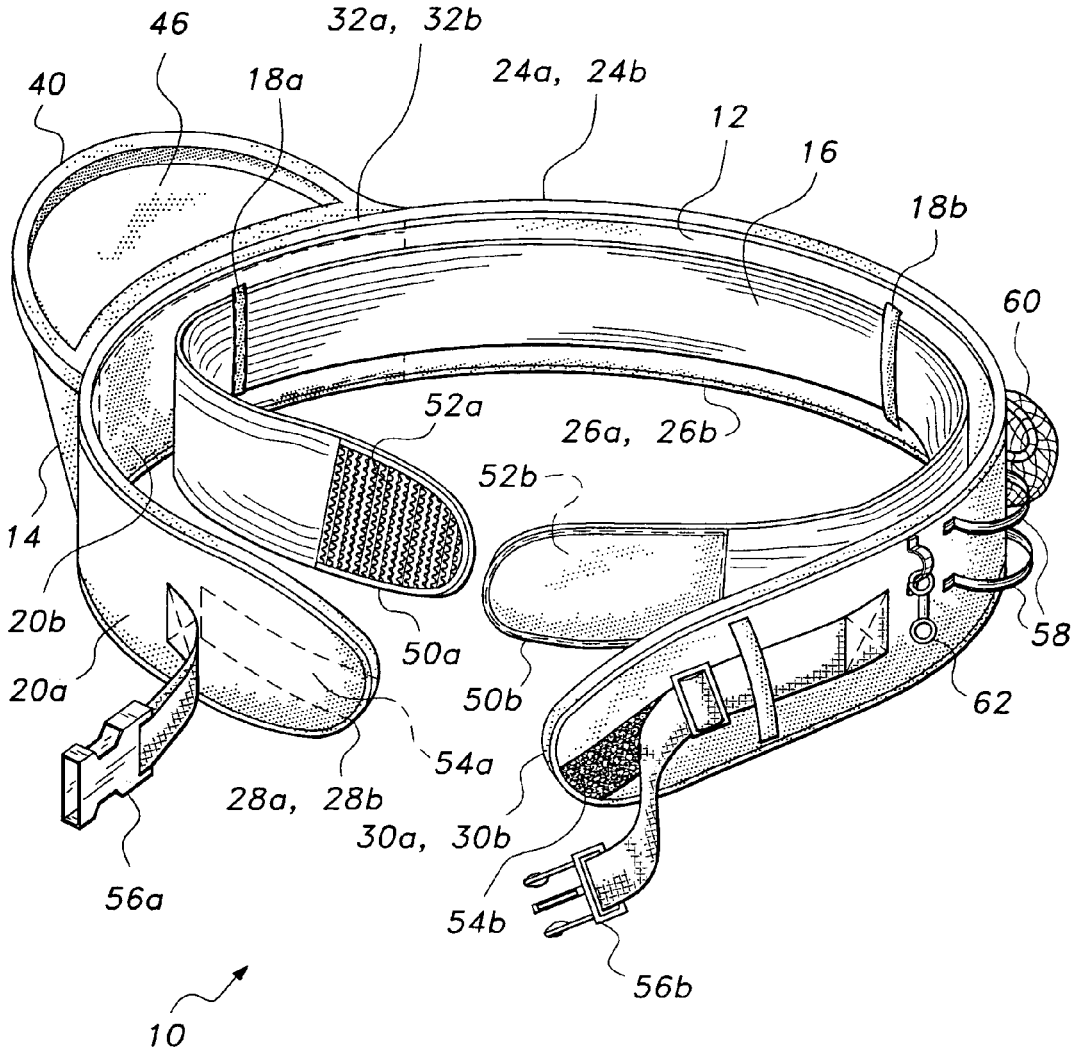
FIG. 2 is a front perspective view of a child carrier belt of the present invention with the inner and outer belt portions unfastened, showing various details of the device.

FIG. 2 provides a more detailed view of the child carrier belt 10. The belt 10 essentially comprises an inelastic, non-stretchable outer belt assembly 12, as noted further above, with an elastic inner belt 16 being secured (either removably or permanently) to the inner surface of the outer belt 12. In the example of FIG. 2, the inner belt 16 is stitched to the inner surface of the outer belt 12 at an attachment 18*a* opposite the child support shelf 14. However, one or more belt loops 18*b* may be provided in lieu of the permanent inner belt attachment 18*a*, if so desired, to allow the elastic inner belt 16 to be removed from the outer belt assembly 12.

The outer belt assembly 12 includes an outer ply 20*a* and an inner ply 20*b*, both formed of flexible but inelastic material. A strong, heavy-gauge synthetic or natural fabric material may be used, or, alternatively, natural materials, such as leather, etc., may be used for the two outer belt plies 20*a* and 20*b*. A relatively thin layer of padding 22, e.g., a soft, open-cell foam material, etc., may be placed between the two plies 20*a* and 20*b* to cushion any contact of the outer belt inner ply 20*b* against the wearer.

Figure 5A:
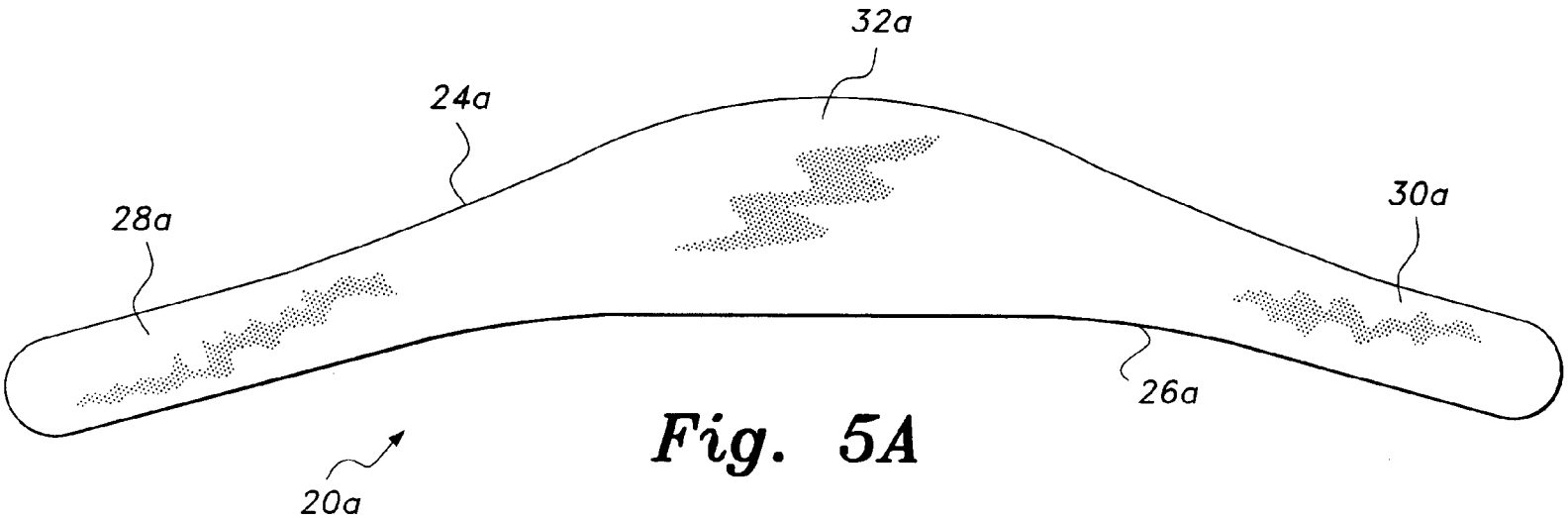
FIG. 5A is an elevation view of the flat pattern for the outer ply of the outer belt of a child carrier belt according to the present invention.
Figure 5B:
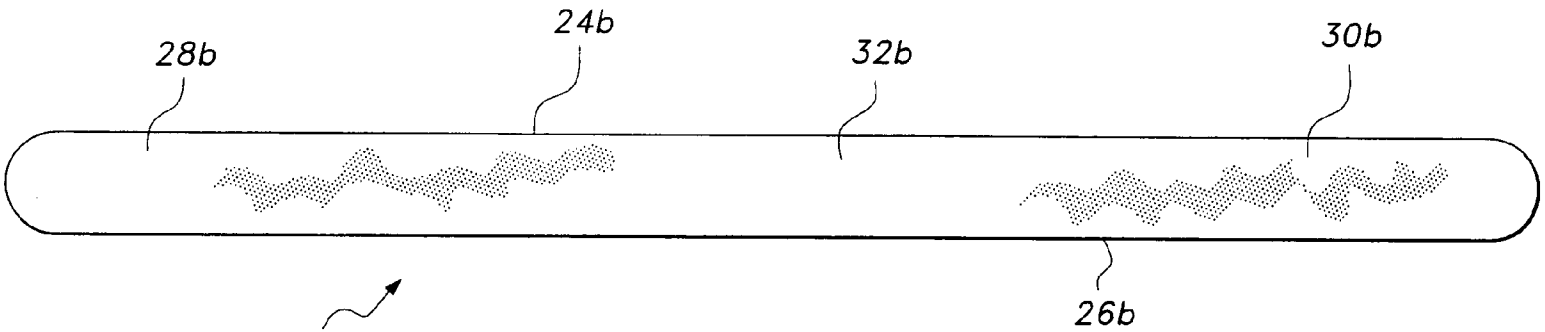
FIG. 5B is an elevation view of the flat pattern for the inner ply of the outer belt of a child carrier belt according to the present invention.

The two plies 20*a* and 20*b* are preferably shaped somewhat differently from one another in order to form the child support shelf integrally with the outer ply 20*a* of the outer belt assembly 12. FIGS. 5A and 5B provide illustrations of exemplary flat patterns that may be used to form the two outer belt plies 20*a* and 20*b*, with their assembly being shown in FIGS. 1 through 3. Each ply 20*a* and 20*b* includes an upper edge, respectively 24*a* and 24*b*, an opposite lower edge, respectively 26*a* and 26*b*, a first end portion, respectively 28*a* and 28*b*, an opposite second end portion, respectively 30*a* and 30*b*, and a medial portion, respectively 32*a* and 32*b*.

However, it will be noted that the two flat patterns for the outer belt outer and inner plies 20*a* and 20*b* are not configured identically to one another. The inner ply 20*b* is relatively straight with the two edges 24*b* and 26*b* defining a relatively constant width therebetween, while the outer ply 20*a* is generally curved, or more specifically, includes an arcuate, generally medial and somewhat wider child support shelf portion 32*a* between the two straight end portions 28*a* and 30*a*. It will be seen that as the upper edge 24*a* is longer than the lower edge 26*a* through the arcuate medial portion of the outer belt outer ply 20*a*, the upper edge 24*a* will bulge or extend outwardly when the outer ply 20*a* is pulled so that the lower edge 26*a* forms a straight line.

This is the configuration the two outer belt plies 20*a* and 20*b* take when they are stitched or otherwise permanently and immovably secured together along the upper and lower edges 24*a*, 24*b* and 26*a*, 26*b* of their mutual first and second end portions 28*a*, 28*b* and 30*a*, 30*b*, and continuously along their mutual lower edges 26*a*, 26*b*. While those portions of their peripheries are secured together, the longer length of the arcuate upper edge of the medial child support shelf portion 32*a* of the outer ply 20*a* extends outwardly away from the corresponding upper edge of the medial portion 32*b* of the inner ply 20*b*. This results in a pocket 34 (shown in FIGS. 3 and 4) being formed between the medial portions 32*a* and 32*b* of the two plies 20*a* and 20*b*, with the outwardly extending outer ply medial portion 32*a* and the span across the upper edges 24*a*, 24*b* of the medial portions 32*a*, 32*b* defining the child support shelf 14. A child support shelf 14 formed in this manner results in both the outer and inner walls or plies of the shelf 14, generally comprising the medial portions 32*a* and 32*b* of the two outer belt plies 20*a* and 20*b*, being unitary, continuous spans of material with the remainder of their respective belt plies. This creates a considerably stronger and more durable child support shelf than would a separate component or components stitched or otherwise secured to the outer ply of the outer belt, although such a separately formed shelf embodiment may be optionally provided, if so desired.

Figure 3:
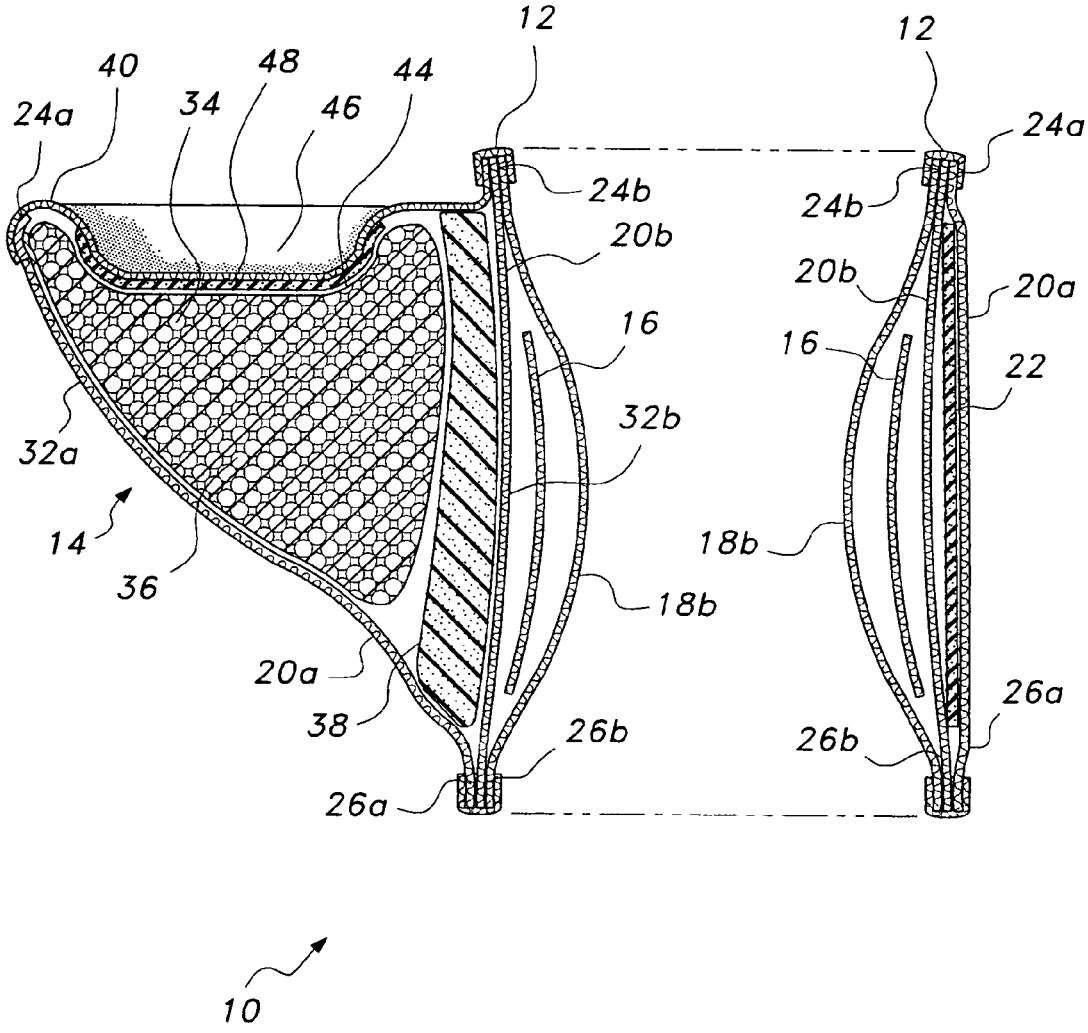
FIG. 3 is a front elevation view in section of a child carrier belt of the present invention, showing various details of the construction of the child support and belt assembly structures.

A rigid child support shelf insert 36 of plastic or inflatable material or other suitable material may be installed within the pocket 34, to maintain the desired shape of the child support shelf 14. The insert 36 may be installed permanently (e.g., adhesively or mechanically fastened) within the pocket 34, or may alternatively be removable. A relatively thick pad 38 is preferably provided between the insert 36 and the inner ply 20*b* of the outer belt assembly 12, as shown in FIG. 3, in order to cushion the pressure of the relatively hard and rigid insert 36 against the hip or waist of the person wearing the belt 10. The pad 38 may comprise an extension and multiple thicknesses of the intermediate padding 22 between the two belt plies 20*a* and 20*b*, as shown in the right side of FIG. 3 and in FIG. 4, or may comprise a separate, relatively thick component of soft and resilient material. Alternatively, the pad 38 may be attached to the insert 36.

Figure 4:
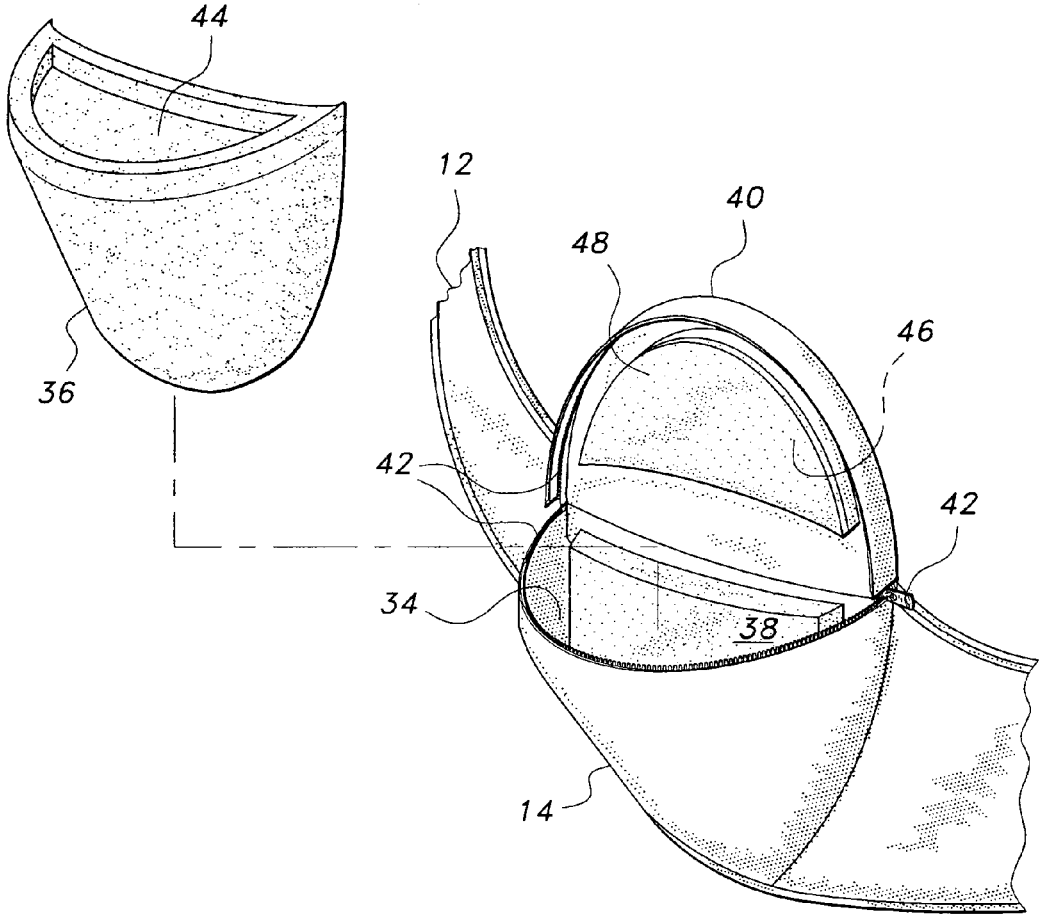
FIG. 4 is an exploded perspective view of the child support portion of a child carrier belt according to the present invention, showing the support pocket opened and the support insert or core removed therefrom.

The pocket 34 may be covered by a cover flap 40 forming an upper layer or top for the child support shelf structure 14. The cover flap 40 may be openable and may be secured closed by a conventional zipper 42 as shown in FIG. 4, or by other conventional closure means, e.g., snaps, hook and loop fabric fastener material, etc. Preferably, the support shelf insert 38 is not permanently secured within the pocket 34 in the openable cover flap embodiment. This allows the shelf insert 38 to be removed, as shown in FIG. 4, and the pocket 34 to be used for the storage of other articles as desired. Alternatively, the insert 38 may be hollowed, or thin, rigid walls (not shown) may be installed within the pocket 34 to hold the shape of the support shelf 14 when a child is being carried thereon, while simultaneously providing storage space within the pocket 34.

Many, if not most, car seats for infants and small children are provided with some structure (e.g., rails, attachment lugs or fittings, etc.) beneath the bottom of the seat for removably securing the seat to an attachment structure, with the attachment structure in turn being secured to a vehicle seat using the conventional seat belt and shoulder harness retaining straps or other securing means. Accordingly, the upper surface of the shelf insert 36 and cover flap 40 may be provided with receptacles, respectively 44 and 46, to receive the understructure of an infant or child seat and prevent the understructure and seat from slipping laterally from the support shelf 14. The two receptacles 44 and 46 are mutually congruent when the cover flap 40 is closed over the top of the support shelf 14 and its insert 36. The peripheral edges of the insert 36 and cover flap 40 define their respective receptacles 44 and 46, and retain the understructure of the child seat atop the support shelf 14. The upstanding peripheral edge of the insert 36, and/or the cover flap 40, may be reinforced in order to preclude breakage or damage. Additional padding 48 may be provided beneath the cover flap 40, positioned between the flap 40 and upper surface of the insert 36 when the cover flap 40 is closed.

The child carrier belt 10 is used by first securing the elastic inner belt 16 about the waist of the wearer, generally at about the position of a conventional belt. The inner belt 16 has opposite end portions 50*a* and 50*b* having mutually connecting fastening means, e.g., mating hook and loop fastener material 52*a* and 52*b*, disposed upon opposite surfaces thereof, as indicated in FIG. 2 of the drawings. The inner belt 16 may be secured reasonably snugly about the wearer's waist, as the elastic material from which the inner belt 16 is formed provides sufficient stretch to allow the wearer to bend and flex comfortably without undue restriction as would be imposed by a non-elastic material.

Once the inner belt 16 has been secured about the wearer's waist, the outer belt assembly 12 is secured about the user's waist over the inner belt 16. Mating belt end attachment means, e.g., mating hook and loop fastener material 54*a*, 54*b*, is provided upon opposite surfaces of the extreme end portions 28*b* and 30*a* (or 28*a* and 30*b*) of the outer belt assembly 12. Supplemental outer belt first and second security strap and buckle assemblies, e.g., the side latch fastener components 56*a*, 56*b* and their corresponding straps, may be provided across the ends 28*a* and 30*a* of the outer belt outer ply 20*a* if additional security is desired. While mating hook and loop fabric fastening material and side latch buckles have been described for the various belt end attachment means, it will be recognized that other equivalent fastening means, e.g., pin-type buckles, snaps, mechanical hooks, etc., may be substituted as desired.

The outer belt assembly 12 is preferably secured about the wearer's waist somewhat more loosely than the elastic inner belt 16, as the inelastic outer belt assembly 12 does not provide any stretch to accommodate bending and flexing of the wearer of the device. However, the elastic inner belt 16 holds the outer belt assembly 12 securely in the desired position about the waist of the wearer, while the outer belt assembly 12 provides the strength required to safely support the load of an infant or small child in a child safety seat S upon the child support shelf 14 of the device. Further convenience may be achieved by providing various accessory holders or attachments upon the outer surface of the outer belt ply 20*a*, as shown in FIGS. 1 and 2. A pair of bottle holding loops 58 is shown in FIGS. 1 and 2, with an open weave or mesh accessory pouch 60 and key ring holder or clasp 62 also being shown in FIG. 2. Other accessory holders or attachments may be included with the present belt in lieu of, or in addition to those specifically shown and discussed.

In conclusion, the child carrier belt in its various embodiments provides a much-improved means of carrying and supporting an infant or small child or portable infant seat upon the person of a parent or guardian. The combination of the elastic inner belt along with the inelastic outer belt assembly permits the device to be secured firmly but comfortably about the waist of the wearer by means of the elastic inner belt, with the outer belt assembly providing the required structural strength to safely support a small child or infant upon the attached child support platform. The resilience of the inner elastic belt assures that the wearer remains comfortable regardless of any bending, stooping, or other postures achieved while also maintaining its position securely about the wearer. The elastic inner belt permits the outer belt to be attached loosely thereto, and thus loosely about the wearer, to permit the necessary freedom of movement for the wearer going about his or her daily routine while safely and securely carrying an infant or small child upon the child support platform extending therefrom.

The child carrier belt is extremely versatile in the various configurations that may be achieved. For example, while the support platform in FIGS. 1 and 2 is shown displaced asymmetrically from the center of the belt structure in order to position the platform laterally over the hip of the wearer when the ends of the belts are positioned at the front of the wearer, it will be seen that the support platform may be positioned centrally along the outer belt assembly, generally as indicated by the outer ply pattern illustrated in FIG. 5A of the drawings. Left and right hand versions of the child carrier belt, or double versions for twins, are easily formed merely by positioning the child support platform, and perhaps any accessory holders, as desired along the length or span of the belt structure. Thus, the child carrier belt will prove to be a most valuable accessory for mothers and others who have occasion to support and carry infants and small children as they go about their daily activities.

It is to be understood that the present invention is not limited to the embodiments described above, but encompasses any and all embodiments within the scope of the following claims.

I claim:

1. A child carrier belt, comprising:

an outer belt having an outer ply made of inelastic material and an inner ply made of inelastic material, the inner ply being permanently and immovably affixed to the outer ply;

a child support shelf integrally formed with the outer ply of the outer belt and extending outwardly from the inner ply;

an inner belt having a single ply of elastic material, the inner belt being secured to the inner ply of the outer belt;

an openable cover flap disposed over said child support shelf;

a child support shelf insert removably disposed beneath the cover flap, said child support shelf insert has an upper surface having a receptacle formed therein; and said cover flap has a receptacle formed therein congruent with the receptacle of said child support shelf insert when said cover flap is closed.

2. The child carrier belt according to claim 1, wherein:

the outer ply of said outer belt has an upper edge, a lower edge opposite the upper edge, a first end portion, a second end portion opposite the first end portion, and an arcuate child support shelf portion therebetween, the child support shelf portion being an integral part of the outer ply and being wider than the first end portion and second end portion;

the inner ply includes a straight length of inelastic material having an upper edge, a lower edge opposite the upper edge, the upper and lower edges defining a constant width therebetween, the length of inelastic material being permanently and immovably affixed to the outer ply along the first end portion, the second end portion, and lower edge thereof; and the child support shelf portion of the outer ply extends outwardly from the inner ply and defines a pocket between the child support shelf portion of the outer ply and the inner ply when the outer ply and the inner ply are assembled to one another, the pocket having a child support shelf insert disposed therein.

3. The child carrier belt according to claim 1, further comprising at least one inner belt loop disposed upon the inner ply, the belt loop removably securing said inner belt to the inner ply of said outer belt.

4. The child carrier belt according to claim 1, further including padding disposed between the outer ply and the inner ply of said outer belt.

5. The child carrier belt according to claim 1, further including at least one accessory holder disposed upon the outer ply of said outer belt.

6. A child carrier belt, comprising an outer belt having:

an outer ply made of inelastic material, the outer ply having an upper edge, a lower edge opposite the upper edge, a first end portion, a second end portion opposite the first end portion, and an arcuate child support shelf portion therebetween, the child support shelf portion being an integral part of the outer ply and being wider than the first end portion and second end portion;

an inner ply made of a straight length of inelastic material having an upper edge and a lower edge opposite the upper edge, the upper and lower edges defining a substantially constant width therebetween, the inner ply being permanently and immovably affixed to the outer ply along the first end portion, the second end portion, and lower edge thereof; and the child support shelf portion of the outer ply extending outwardly from the inner ply and defining a pocket between the child support shelf portion and the inner ply when the outer ply and the inner ply are assembled to one another, the pocket having a child support shelf insert disposed therein: and further including an inner belt made from a single ply of elastic material, the inner belt being secured to the inner ply of said outer belt.

7. The child carrier belt according to claim 6, further including at least one inner belt loop disposed upon the inner ply of said outer belt, the belt loop removably securing said inner belt to the inner ply of said outer belt.

8. The child carrier belt according to claim 6, further including padding disposed between the outer ply and the inner ply of said outer belt.

9. The child carrier belt according to claim 6, further including:

an openable cover flap disposed over said child support shelf; and a rigid child support shelf insert removably disposed beneath the cover flap.

10. The child carrier belt according to claim 9, wherein:

said child support shelf has an upper surface having a receptacle formed therein; and said cover flap has a receptacle formed therein congruent with the receptacle of said child support shelf when said cover flap is closed.

11. The child carrier belt according to claim 6, further including at least one accessory holder disposed upon the outer ply of said outer belt.

12. A child carrier belt, comprising:

an outer belt having an outer ply made of inelastic material and an inner ply made of inelastic material, the inner ply being permanently and immovably affixed to the outer ply;

a child support shelf permanently and immovably affixed to the outer ply and extending outwardly therefrom;

an inner belt consisting essentially of a single ply of elastic material, said inner belt including opposite ends portions having mutually connecting fastening elements; and at least one inner belt loop disposed upon the inner ply of the outer belt, the inner belt loop removably securing the inner belt to the inner ply of the outer belt.

13. The child carrier belt according to claim 12, wherein:

the outer ply of said outer belt has an upper edge, a lower edge opposite the upper edge, a first end portion, a second end portion opposite the first end portion, and an arcuate child support shelf portion therebetween, the child support shelf portion being an integral part of the outer ply and being wider than the first end portion and second end portion;

the inner ply includes a straight length of inelastic material having an upper edge, a lower edge opposite the upper edge, the upper and lower edges defining a substantially constant width therebetween, the length of inelastic material being permanently and immovably affixed to the outer ply along the first end portion, the second end portion, and lower edge thereof; and the child support shelf portion of the outer ply extends outwardly from the inner ply and defines a pocket between the child support shelf portion of the outer ply and the inner ply when the outer ply and the inner ply are assembled to one another, the pocket having a child support shelf insert disposed therein.

14. The child carrier belt according to claim 12, further including padding disposed between the outer ply and the inner ply of said outer belt.

15. The child carrier belt according to claim 12, further including:

an openable cover flap disposed over said child support shelf; and a rigid child support shelf insert removably disposed beneath said cover flap.

16. The child carrier belt according to claim 15, wherein:

said child support shelf has an upper surface having a receptacle formed therein; and said cover flap has a receptacle formed therein congruent with the receptacle of said child support shelf when said cover flap is closed.

* * * * *